United States Patent [19]

Mullins

[11] Patent Number: 4,625,965

[45] Date of Patent: Dec. 2, 1986

[54] GOLF PUTTER

[76] Inventor: Fagan Mullins, 2813 W. Harris, San Angelo, Tex. 76901

[21] Appl. No.: 749,776

[22] Filed: Jun. 28, 1985

[51] Int. Cl.[4] ..... A63B 53/14

[52] U.S. Cl. ..... 273/81.3; 273/80 C

[58] Field of Search ..... 273/81.3, 80 C, 77 B, 273/168, 81 D, 165, 166, 81 C; D21/217, 218, 219

[56] References Cited

U.S. PATENT DOCUMENTS

| | | | |
|---|---|---|---|
| 1,561,349 | 11/1925 | Murphy et al. | 273/81.3 |
| 2,204,974 | 6/1940 | Strasser | 273/168 X |
| 2,212,651 | 8/1940 | Sanderson | 273/80 C X |
| 3,123,359 | 3/1964 | Lindgren | 273/81.3 |
| 3,332,684 | 7/1967 | Solheim | 273/81.3 |
| 3,486,755 | 12/1969 | Hodge | 273/168 X |
| 4,163,554 | 8/1979 | Bernhardt | 273/77 B |

FOREIGN PATENT DOCUMENTS

| | | | |
|---|---|---|---|
| 388596 | 3/1933 | United Kingdom | 273/81.3 |

*Primary Examiner*—George J. Marlo
*Attorney, Agent, or Firm*—Harvey B. Jacobson

[57] ABSTRACT

A golf putter has the upper part of the grip bent rearwardly and anteriorly with respect to the putter face. A golfer places his bottom hand in conventional position on the lower part of the grip with the thumb pointing substantially down the front of the shaft and the golfer places the top hand in inverted position on the bent upper portion of the grip with the thumb behind the grip and the fingers of the top hand resting on the inside forearm of the bottom hand. This produces a locked putting grip for promoting a smooth and consistent putting stroke.

1 Claim, 6 Drawing Figures

GOLF PUTTER

BACKGROUND OF THE INVENTION

Consistent putting is a deceptively illusive facet of the game of golf, and considerable attention has been, and continues to be directed toward improving putting techniques, equipment and practicing aids. There is a myriad of putting aids, gadgets and the like available to golfers and a myriad of available instructional material. Moreover, putting being a highly individualistic action, apparently small differences in equipment design, or in technique, frequently may provide surprising improvements in an individual's putting performance.

Another aspect of putting which may be mentioned is an affliction commonly referred to as the "yips" which may, in serious cases, totally preclude an afflicted individual from executing a smooth and consistent putting stroke.

Despite the myriad of available putting aids, there is, as yet, no universal putting panacea. Accordingly, modifications in putting techniques and equipment still tend to be eagerly sought and anticipated by golfers interested in improving their performance. The present invention provides several modifications, which may, at least for certain individuals, produce a smoother putting stroke and improved putting performance.

STATEMENT OF PRIOR ART

The following U.S. patents relate to golf clubs, methods of using same, and the like. None of the patents, however, discloses the features of the present invention:

U.S. Pat. No. 1,201,728, C. S. Henry 2d et al, Oct. 17, 1916;

U.S. Pat. No. 1,979,174, C. D. Robertson, Oct. 30, 1934;

U.S. Pat. No. 2,212,651, A. J. Sanderson, Aug. 27, 1940;

U.S. Pat. No. 2,949,304, W. S. Williams, Aug. 16, 1960;

U.S. Pat. No. 4,269,412, J. W. Hughes, May 26, 1981;

U.S. Pat. No. Des. 213,838, R. O. McAllister, Apr. 15, 1969;

U.S. Pat. No. Des. 256,824, D. T. Ward et al, Sept. 9, 1980.

SUMMARY OF THE INVENTION

Broadly stated, it is an object of the invention to provide a novel form of putter and method of using same to promote a smooth and consistent putting stroke. To this end, the invention provides a putting grip wherein the golfer's bottom hand (normally the right hand in the case of a right-handed golfer and the left hand in the case of the left-handed golfer) is placed on the putter shaft in a conventional position with the thumb facing generally down the outside of the shaft, while the golfer's other or top hand is placed on the putter shaft in a reverse or inverted position with the thumb to the top preferably behind the grip and with the back of the hand generally to the front of the shaft. To facilitate gripping a putter in this manner, a putter in accordance with the invention has a grip with a conventional lower portion which is an extension of the shaft for receiving the golfer's bottom hand, while the upper portion of the grip, for gripping with the top hand, is bent back away from the putter face, at an angle comfortable to a user and which typically may be about 20°, and preferably is also bent anteriorly, i.e. in a direction away from the user's body also at about 20°. Alternatively stated, the upper portion of the grip is bent substantially to conform with and follow the contour of the inner forearm of the user's bottom hand, so that when the top hand is placed on the grip in the prescribed manner, "a locked" grip is produced, with the fingers of the top hand closed on the grip and resting comfortably against the inner forearm of the bottom hand. To conform more closely with the inner forearm, the upper portion of the grip may be somewhat curved.

It is found that by gripping a putter as described in the prescribed manner, with the "locked" putting grip, this tends to induce an improved putting stroke by diminishing wristiness and causing a golfer to putt more with the large upper arm and shoulder muscles.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 2:
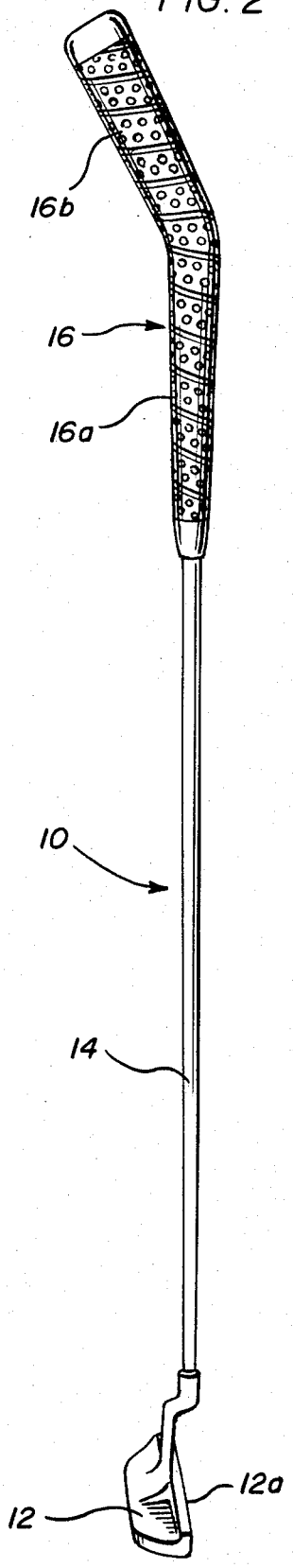
FIG. 2 is an enlarged elevational view of the putter.
Figure 3:
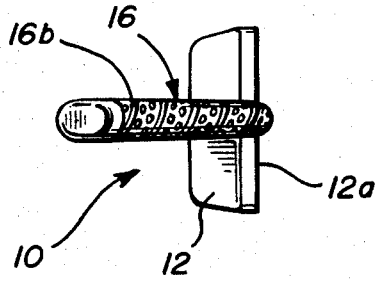
FIG. 3 is a plan view of the putter.

Referring initially to FIGS. 2 and 3, there is shown a golf putter 10 in accordance with the invention, which includes a putter head 12, a shaft 14, and a grip 16. The head in the illustrated embodiment is of the center-shaft type but this is for purposes of illustration only, and any other type of putter head, such as a blade or mallet can also be used. Likewise, grip 16 is illustrated as a wound leather grip, but this is also for illustration only, and other conventional grips, such as a slip-on leather or composition rubber grip can also be used.

It will be noted that the lower end portion **16*a* of the grip is formed as a regular linear extension of shaft 14, whereas the upper portion 16*b* is formed by bending the shaft rearwardly with respect to the putter face 12*a***. The angle of the bend may preferably be about 20°.

Figure 1:
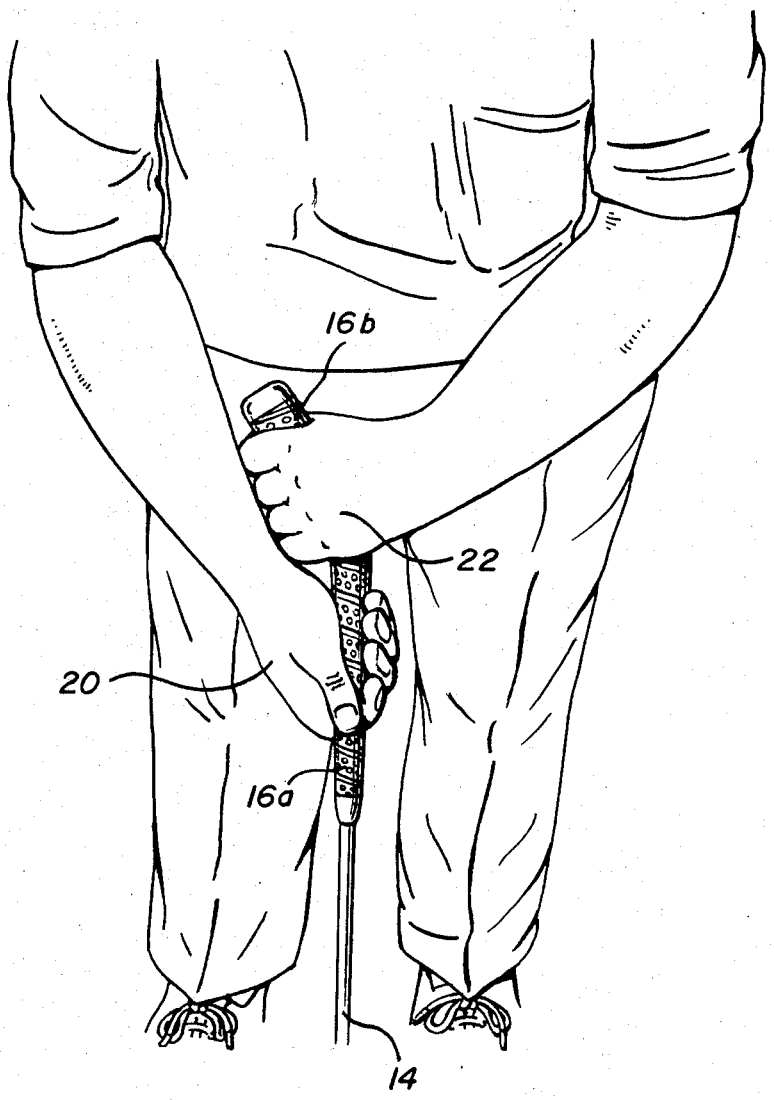
FIG. 1 is an elevational view of a golfer using a putter and grip in accordance with the invention.

The purpose of bending the upper part of the grip portion of the shaft rearwardly with respect to the putter face is to promote conformance of grip portion **16*b* of the putter with the contour of the inner forearm of a golfer's bottom hand and facilitate gripping of the putter in accordance with the invention, in the manner shown in FIG. 1. Thus, in the inventive grip, a golfer's bottom hand 20 is placed in substantially conventional position on the lower portion 16*a* of the grip with the thumb pointing substantially down the front of the shaft. The bent upper portion 16*b* of the grip, however, promotes placing of the golfer's top hand 22** in inverted or reverse position on the grip with the back of the hand facing forward and the thumb at the top wrapped around the back of the grip, the folded fingers and knuckles of the top hand preferably resting along the inside of the extended wrist and forearm of the bottom hand. A "locked" grip is thus formed on the putter promoting a smoother putting stroke by the use of the golfer's upper arm and shoulder muscles with diminished use of the small lower arm, wrist and hand muscles. A pendulum-type less wristy and more consistent putting stroke may therefore result.

The putter grip is designed to accommodate the player's hands in such a manner that the muscle groups of the shoulder and arm are not in an antagonistic position (conventional golf grips pit muscle groups against each other resulting in discomfort, lack of control, tension and making the body act in an unnatural fashion. However, the present putter grip gives a player a manner of gripping a putter in such a way that allows the shoulder and arm muscles to act as a unit. This gives the player a more natural stroke in different ways. Thus, when stroking the ball, it is desirable that the angle formed by the player's upper arm and forearm (at the elbow) be maintained throughout the stroke, it being undesirable for this arm to extend or flex during the stroke. The present grip forces the player to the degree that his upper hand is "locked" up against the lower forearm, to "lock-in" or maintain the angle of the upper elbow throughout the stroke. When "locking" the upper wrist up against the bottom forearm, the wrists are likewise maintained in such a manner so as to prevent rotation, flexion or extension of the wrists (wristiness). The grip has now facilitated the proper stroke alignment so that contact between the putter head and the ball is square. This helps keep the ball on a desired line. The locked angle of the upper elbow produces the proper arc in the putting stroke by effectingly "lifting" the putter in the follow-through portion of the stroke. This lift causes the putter to make the ball roll, rather than simply skid. The roll keeps the ball on the desired line and is therefore more controlled.

Figure 4:
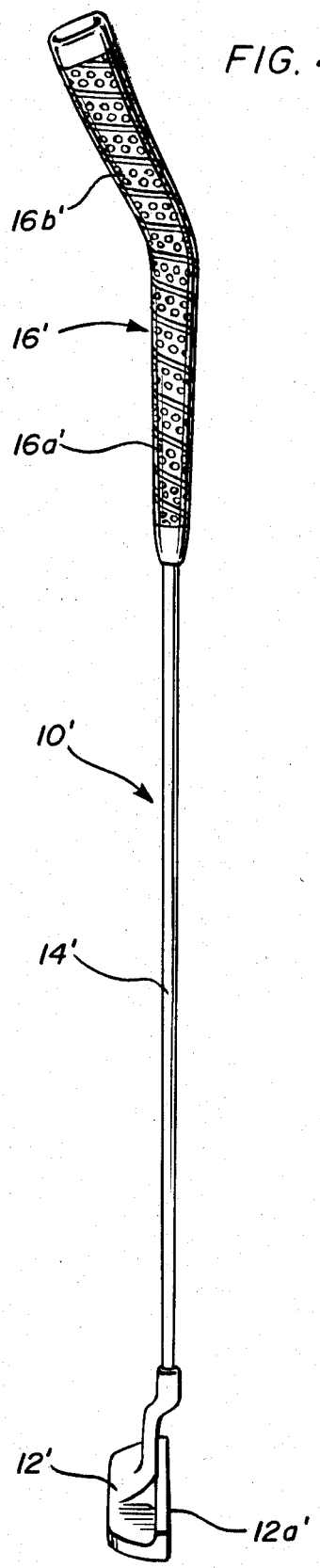
FIG. 4 is an elevational view of a further putter in accordance with the invention.
Figure 5:
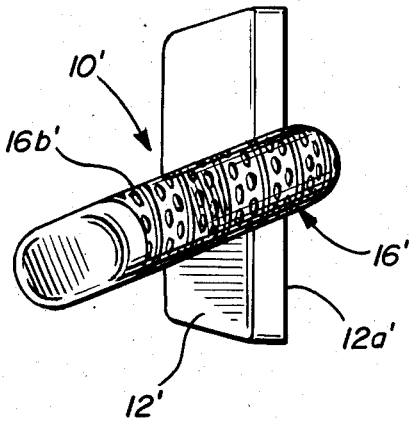
FIG. 5 is a plan view of the further putter looking toward the putter face.
Figure 6:
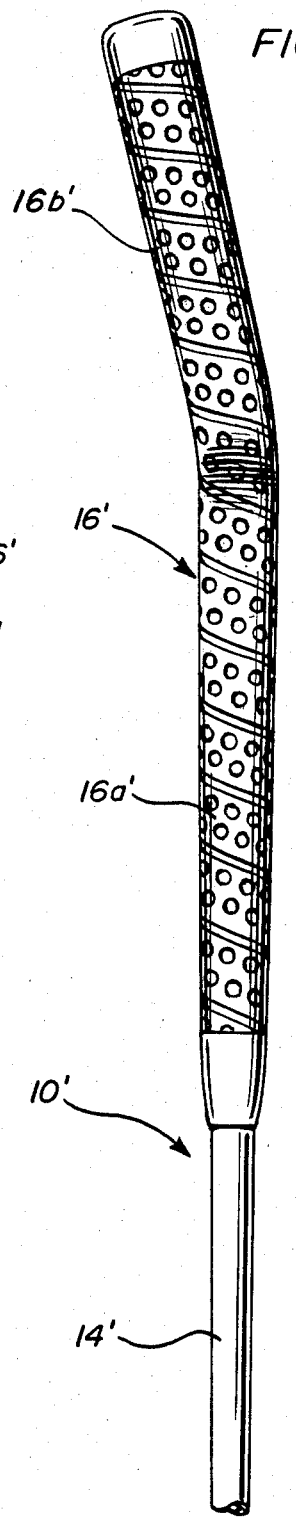
FIG. 6 is an enlarged elevational view of the further putter.

As noted above, the bend in the upper portion of the putter grip is to promote conformance of this portion of the grip to the contours of the inner forearm of the golfer's bottom hand, so as to induce the "locked" grip. A more preferred form of putter 10' for obtaining this objective is shown in FIGS.4–6. Putter 10' is similar to the previously described putter 10 but, so that upper grip portion **16*b'* may conform even more closely to the inner forearm as aforesaid, portion 16*b'*** is bent not only rearwardly of the putter face as previously but is also bent anteriorly, i.e. in a direction away from the golfer's body, at about the same angle, and may be slightly curved as shown.

While right-handed putters have been illustrated and described herein, it is understood that the invention is equally applicable to left-handed putters. Also, the bends defining the upper part of the grip may be altered somewhat from those described in order to improve conformance to the inner forearm of an individual's bottom hand with the fingers of the top hand resting on the forearm.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A putter having a putter head, a shaft, and grip means for permitting the execution of a putting stroke while gripping the putter with a golfer's one hand placed in position on the grip means with the thumb pointing substantially down the front of the shaft, and with the golfer's other hand placed in inverted position on the grip means above the one hand with the back of the other hand at the front of the grip means, with the thumb of the other hand at the top of the grip means around the back of the grip means, and with the knuckles of the other hand resting along the inner forearm of the golfer's one hand, the grip means comprising a lower portion of sufficient length for receiving the golfer's one hand, the lower portion being a linear extension of the shaft, and an upper portion of sufficient length for receiving only the golfer's other hand, wherein the upper portion of the grip means is bent rearwardly with respect to the putter face and said lower portion.

* * * * *